US005495973A

United States Patent [19]

Ishizawa et al.

[11] Patent Number: 5,495,973

[45] Date of Patent: Mar. 5, 1996

[54] NAIL GUN HAVING SAFETY DEVICE FOR PREVENTING ACCIDENTAL FIRINGS

[75] Inventors: Yoshinori Ishizawa; Katsuaki Tobita, both of Katsuta, Japan

[73] Assignee: Hitachi Koki Co., Ltd., Tokyo, Japan

[21] Appl. No.: 191,920

[22] Filed: Feb. 4, 1994

[30] Foreign Application Priority Data

Feb. 5, 1993 [JP] Japan ..... 5-003027 U
Jan. 21, 1994 [JP] Japan ..... 6-005286

[51] Int. Cl.[6] ..... B25C 1/04

[52] U.S. Cl. ..... 227/8; 227/113; 227/130; 227/140

[58] Field of Search ..... 227/8, 113, 130, 227/147, 149, 119, 140

[56] References Cited

U.S. PATENT DOCUMENTS

| | | | |
|---|---|---|---|
| 3,341,101 | 9/1967 | Butler et al. | 227/8 |
| 3,675,838 | 7/1972 | Bakoledis | 227/8 |
| 3,809,307 | 5/1974 | Wandel et al. | 222/8 |
| 4,351,464 | 9/1982 | Fehrs et al. | 227/8 |
| 4,389,012 | 6/1983 | Grikis et al. | 227/113 |
| 4,480,528 | 11/1984 | Shiroyama | 227/130 |
| 4,821,937 | 4/1989 | Rafferty | 227/8 |

FOREIGN PATENT DOCUMENTS

| | | | |
|---|---|---|---|
| 53-9007 | 3/1978 | Japan | B25C 1/04 |
| 516077 | 1/1993 | Japan | B25C 1/04 |

*Primary Examiner*—Richard K. Seidel
*Assistant Examiner*—Allan M. Schrock
*Attorney, Agent, or Firm*—Sughrue, Mion, Zinn, Macpeak & Seas

[57] ABSTRACT

A pneumatically operated nail gun having a safety device which prevents a trigger lever from being accidentally manipulated. The gun has a nail guide movably disposed over a bit guide. A movable segment having a pipe-shaped portion and an arm portion formed integrally therewith is provided. The pipe-shaped portion is disposed movably in the nail guide, and the arm portion is movable in a slit of the nail guide. The arm portion is coupled to the safety arm whose end portion is engageable with the trigger lever. A spring is provided to urge the safety arm in a direction to maintain engagement between the end portion and the trigger lever. When the nail inserted in the nail guide is depressed onto the workpiece, the pipe-shaped portion moves against the biasing force of the spring, so that the end portion of the safety arm disengages from the trigger lever, whereupon the trigger lever can be operated.

9 Claims, 6 Drawing Sheets

NAIL GUN HAVING SAFETY DEVICE FOR PREVENTING ACCIDENTAL FIRINGS

BACKGROUND OF THE INVENTION

The present invention relates to an improvement on a nail gun described in Japanese Patent Application Kokai No. HEI5-16077 filed by the present assignee. More particularly, the present invention improves safety of a pneumatically operated nail gun for striking with a bit a head of a nail inserted into and supported by a nail guide of the nail gun so that the nail protrudes from the nail guide when supported therein.

Japanese Patent Application Kokai No. HEI5-16077 describes a light-weight nail gun for driving in nails long enough to protrude from the nail guide when supported therein with two to five strikes. The above-described nail gun is designed to be used in the manner of a hand-held hammer which drives in nails of the same size with a similar number of strokes.

The following text will provide an explanation of the nail gun according to Japanese Patent Application Kokai No. HEI5-16077 with reference to FIG. 1. Expressions such as "upward," "downward," "above," "below," "upper surface," and "lower tip" are used in explanations of conventional art and the present invention to define the various parts when a nail gun is disposed in an orientation for driving a nail downward into a workpiece.

FIG. 1 shows the nail gun in a non-firing mode. A drive air chamber 4 provided in a grip 51 of the nail gun is filled with compressed air from a compressor C. The compressed air enters the drive air chamber 4 through an air entrance port 3. An air passage 57 (to be described later) is also formed in the drive air chamber 4.

A trigger valve chamber 5 is formed with a trigger valve hole 52 and an atmospheric communication hole 53. A trigger valve plunger 12 is supported in the trigger valve chamber 5 so as to be movable in the vertical direction, that is, from in the trigger valve hole 52 towards and into the atmospheric communication hole 53 and vice versa. A trigger valve spring 17 urges the trigger valve plunger 12 to plug the atmospheric communication hole 53. A trigger lever 11 abuts the trigger valve plunger 12 so that when the trigger lever 11 is pulled, the trigger valve plunger 12 pulls out of the atmospheric communication hole 53 against the urging of the trigger valve spring 17 and plugs the trigger valve hole 52. When the trigger lever 11 is released, it returns to its initial position by the urging of the trigger valve spring 17. The trigger valve chamber 5 is in fluid communication with a head valve chamber 7 via an air passage 6. In the non-firing mode shown in FIG. 1, the drive air chamber 4 is in fluid communication with the trigger valve chamber 7 via the trigger valve hole 52. Therefore, during the non-firing mode, compressed air from the drive air chamber 4 fills the head valve chamber 7 by passing through the trigger valve hole 52, the trigger valve chamber 5, and the air passage 6.

The lower wall of the head valve chamber 7 is formed by a surface of a head valve 8. Below the head valve 8 is provided a cylinder 9. A piston 10 is supported in the chamber of the cylinder 9 so as to be movable in the vertical direction. The piston 10 hermetically separates the cylinder chamber into an upper cylinder space 58 and a lower cylinder space 59. A through hole 54 is formed through the head valve 8. A spring 55 provided in the through hole 54 urges the head valve 8 downward. In the non-firing mode, the combination of the urging of the spring 55 and the compressed air in the head valve chamber 7 presses the head valve 8 against the upper surfaces of the cylinder 9 and the piston 10, forming a seal between the head valve 8 and the cylinder 9. This seal prevents compressed air in the drive chamber 4 from entering the upper cylinder space 58 through the air passage 57. In the non-firing mode, the upper cylinder space 58 is in fluid communication with the atmosphere via the through hole 54 and an exhaust hole 18.

Next, a firing mode of the nail gun will be explained. To start the firing mode, an operator pulls the trigger lever 11. The trigger lever 11 pushes the trigger valve plunger 12 out of the atmospheric communication hole 53 and into the trigger valve hole 102. This blocks communication between the drive air chamber 4 and the trigger valve chamber 5, and brings the trigger valve chamber 5 into communication with the atmosphere via the atmospheric communication hole 53. As a result, compressed air in the head valve chamber 7 escapes to the atmosphere through the air passage 6, the trigger valve chamber 5 and the atmospheric communication hole 53.

When the pressure in the head valve chamber 7 drops to atmospheric pressure, the pressure of the compressed air in the air passage 57 is sufficient to overcome the downward urging of the spring 55, thereby raising the head valve 8. This blocks fluid communication between the atmosphere and the upper cylinder space 58 while at the same time bringing the upper cylinder space 58 into fluid communication with the drive air chamber 4 via the air passage 57, since the lower surface of the head valve 8 is moved away from the upper surface of the cylinder 9. Compressed air enters the upper cylinder space 58, thereby forcing the piston 10 downward. As the piston 10 moves downward, pressure of the air in the lower cylinder space 59 increases, forcing the air through middle holes 14 and lower holes 19 formed in the cylinder 9. The air forced through the middle holes 14 and lower holes 19 enters a return air chamber 16 formed around the cylinder 9. When the piston 10 passes below the middle holes 14, rubber rings 15 formed to the middle holes 14 prevent air from passing from the return air chamber 16 into the upper cylinder space 58. Pressure in the return air chamber 16 continues to increase until the piston 10 hits the damper 13 provided at the base of the cylinder chamber for cushioning the impact of the piston 10.

At this point the piston 10 abuts the damper 13. While the trigger lever 11 is being pulled, the piston 10 is forced into this dead center position by compressed air from the drive air chamber 4. However, when the trigger lever 11 is released, the head valve chamber 7 is again brought into communication with the compressed air in the drive air chamber 4. The head valve 8 is forced downward against the cylinder 9, thereby bringing the upper cylinder space 58 into communication with the atmosphere via the through hole 54 and blocking communication between the upper cylinder space 58 and the drive air chamber 4. The compressed air in the upper cylinder space 58 is exhausted through the exhaust hole 18 and the high pressure of the air in the return chamber 16 forces the piston 10 upward into its initial position.

A bit 20 integrally formed to the underside of the piston 10 is inserted into a bit guide 21 bolted onto the housing 2 below the cylinder 9. The bit guide 21 is formed with a hole for receiving the bit 20. A cylindrical nail guide 24 is supported on the tip of the bit guide 21 by a nail guide holder 27 so as to be movable in the vertical direction. A first spring 23 is provided in the nail guide holder 27 between the bit guide 21 and an upper peripheral plunger of the nail guide 24 so as to urge the nail guide 24 downward.

The following text will describe a nail driving operation. A nail 30 to be driven is inserted into the nail guide 24. In this case, the nail 30 is partially projected out of the nail guide 24. The nail gun is pressed against a workpiece 29 made of, for example, wood, through the nail 30. An operator pulls the trigger lever 11, thereby causing compressed air to force the piston 10 downward as described above. The bit 20 moves downward with the movement of the piston 10 as guided by the hole in the bit guide 21. The bit 20 strikes the head of the nail 30 supported in the nail guide 24. The operator releases the trigger lever 11, whereupon the piston 10, and also the bit 20, returns to its initial position as described above. Consequently, the nail 30 can be repeatedly struck by repeatedly pulling and releasing the trigger lever 11.

When the nail 30 is driven into the workpiece 29 to the extent where the nail guide 24 abuts the workpiece 29, the pressure exerted on the nail gun by the operator forces the nail guide 24 into the nail guide holder 27 against the urging of the first spring 23. In this way, an appropriate distance can be continually maintained between the bit 20 and the head of the nail until the nail 30 is pounded level with the surface of the workpiece 29. When the nail 30 is completely driven into the workpiece 29, the trigger lever 11 is released so it returns to its original position pictured in FIG. 1.

However, in the nail gun disclosed in the JP5-16077 publication, several problems are acknowledged.

If an operator places his finger on the trigger lever 11 when carrying the nail gun or when inserting a nail 30, he can accidentally pull the trigger lever 11, causing the piston 10 to plunge down and push the bit 20 rapidly out of the nail guide 24. The bit 20 can drive into and damage the workpiece or articles other than the workpiece. There is also the danger of the operator himself being injured by the bit 20. Also, operating the piston 10 when no nail 30 is inserted in the nail guide 24, that is, when the nail gun is empty, can damage the piston 10 or the damper 13.

Another conventional nail gun is provided with a safety system, where a safety arm is vertically movably provided near the firing portion which guides the nail. By the upper tip of the safety arm is provided a safety device for preventing operation of the trigger lever so that the trigger lever can not be operated unless the firing portion is pressed against the workpiece. However, in this type of conventional nail gun, the nail is completely hidden within the nail guide, so that the safety arm can be provided near the firing portion. On the other hand, in the nail gun described in the JP 5-16077 publication, since the applied nail 30 has a long length which protrudes out of the lower tip end of the nail guide 24, the protruding nail 30 prevents the nail guide 24 from being directly pressed against the workpiece 29. Therefore, the above-described safety device cannot be utilized.

SUMMARY OF THE INVENTION

It is therefore an object of the present invention to overcome the above-described drawbacks, and to provide a nail gun wherein the trigger lever can be operated or becomes effective only when the nail tip of a nail inserted in the nail guide is pressed against the workpiece, thus improving safety of the nail gun.

In order to attain the above objectives, in a nail gun according to the present invention a safety arm is provided so that a tip thereof prevents or ineffectualizes operation of the trigger lever. A movable segment is provided so as to rise when a nail inserted in a nail guide is pressed against a workpiece. The safety arm is provided so as to rise with a rising of the movable segment so that the tip of the safety arm no longer prevents or ineffectualizes operation of the trigger lever.

That is, the present invention provides a pneumatically operated nail gun for striking a head of a nail into a workpiece including a housing frame for providing a compressed air chamber connected to a compressed air source, a cylinder disposed in the frame, a piston slidably movable in the cylinder and driven by the compressed air, a bit connected integrally to the piston for striking the head of the nail, a trigger lever for selectively applying the compressed air in the compressed air chamber to the piston to move the bit, a bit guide fixed to a lower end of the housing frame for guiding reciprocal travel of the bit, a nail guide disposed over and movably supported to the bit guide, the nail guide having an inner diameter greater than an outer diameter of a head of the nail, the nail having a sufficient length which is protruding from the nail guide when inserted and set therein, the improvement comprising said nail guide being formed with an axially oriented slit at one side thereof, a movable segment having a pipe-shaped portion and arm portion connected to the pipe-shaped portion, the pipe-shaped portion being movably disposed in the nail guide and having a inner diameter greater than an outer diameter of the bit, the arm portion being movable within the slit, a safety arm having one end positioned adjacent the trigger lever and another end coupled to the arm portion, said one end of the safety arm being selectively engageable with the trigger lever to render the latter inoperative, and a biasing spring connected to the one end of the safety arm for urging the safety arm in one direction to maintain engagement between the one end of the safety arm and the trigger lever. The bit is protrudable through the pipe-shaped portion to strike the head of the nail when the piston is pneumatically moved.

With the nail gun according to the present invention structured as described above, unless the nail inserted in and protruding from a nail guide is pressed against a workpiece, the trigger lever can not be operated or the trigger lever becomes ineffectual. Therefore, the piston will not be accidentally operated, thereby improving the safety of the nail gun and increasing the life of the nail gun.

Also, because the nail protrudes from the lower tip of the nail guide, the nail can be more accurately aimed at the hole of metal fittings such as metal hinges.

BRIEF DESCRIPTION OF THE DRAWINGS

The above and other objects, features and advantages of the invention will become more apparent from reading the following description of the preferred embodiment taken in connection with the accompanying drawings in which.

DETAILED DESCRIPTION OF THE PREFERRED EMBODIMENTS

Figure 1:
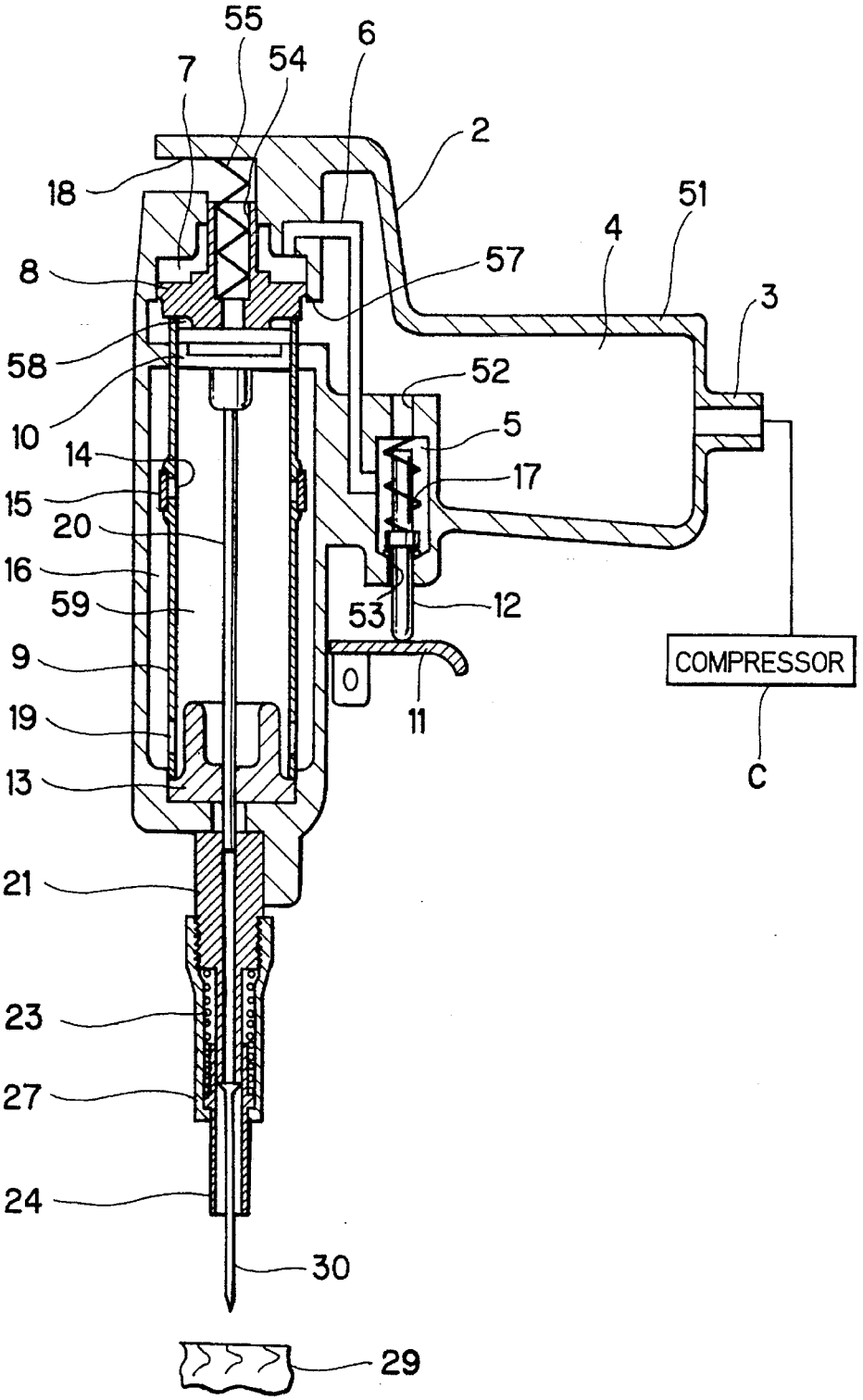
FIG. 1 PRIOR ART
FIG. 1 is a longitudinal cross-sectional view showing a conventional nail gun.

A nail gun according to preferred embodiments of the present invention will be described while referring to the accompanying drawings wherein like parts and components are designated by the same reference numerals as those shown in FIG. 1 to avoid duplicating description.

Figure 2:
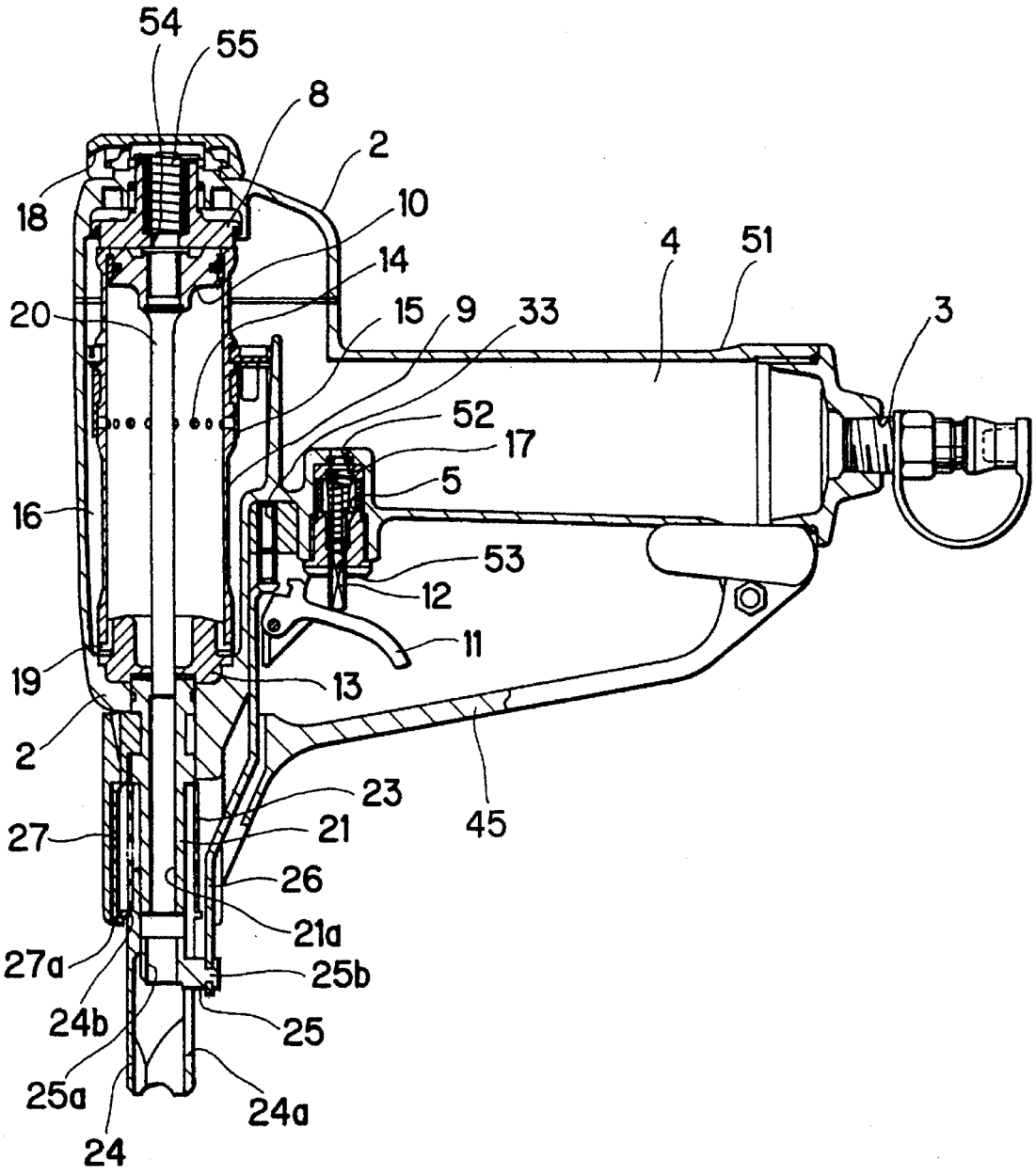
FIG. 2 is a longitudinal cross-sectional view showing a nail gun according to a first preferred embodiment of the present invention.

The bit guide 21 fixed to the housing 2 at a position below the cylinder 9 is formed with a hole 21*a* in which the bit 20 is reciprocally movable. The hole 21*a* has a diameter smaller than the diameter of the head of a nail 30 (not shown in FIG. 2) to be driven, but larger than the diameter of the neck of the nail 30. The nail guide 24 is slidably disposed over the bit guide 21. The nail guide 24 has a flanged portion 24*b*, and is formed with a vertically running slit 24*a* along a portion of its side. The nail guide 24 is formed with an inner diameter larger than the diameter of the head of the nail 30. A first spring 23 is interposed between the bit guide 21 and the flanged portion 24*b* for normally urging the nail guide 24 to extendible direction.

The nail guide holder 27 is disposed over the bit guide 21. The nail guide holder 27 has a lower stepped portion 27*a* engageable with the flanged portion 24*b* of the nail guide 24. Thus, the nail guide holder 27 prevents the nail guide 24 from lowering more than a predetermined amount. In other words, the lowermost position of the nail guide 24 is defined by the abutment of the flanged portion 24*b* onto the lower stepped portion 27*a*.

A protective cover 45 is provided around the trigger lever 11 for preventing the trigger lever 11 from being accidentally pulled when the nail gun is, for example, dropped. The cover 45 is formed from a synthetic resin such as nylon. The front part of the cover 45 extends from the rear part of the housing 2 and is mounted to the nail guide holder 27.

A movable segment 25 having a pipe-shaped portion 25*a* and an arm portion 25*b* is provided. The pipe-shaped portion 25*a* is supported within the inner wall of the nail guide 24 movably in the vertical direction. An arm portion 25*b* protrudes from the slit 24*a* in the nail guide 24. The inner diameter of the pipe-shaped portion 25*a* is formed larger than the diameter of the bit 20 and the neck of the nail 30, but smaller than the diameter of the head of the nail 30. A safety arm 26 is provided selectively engageable with the trigger lever 11. One end of the safety arm 26 is coupled to the arm portion 25*b* of the movable segment 25, and another end of the safety arm 26 is positioned adjacent the trigger lever 11. A second spring 33 is interposed between the housing 2 and the other end of the safety arm 26 for urging the safety arm 26 in a direction to allow the other end of the safety arm to engage the trigger lever 11.

More specifically, the second spring 33 urges the safety arm 26, and consequently the movable segment 25, downward. When the safety arm 26 is lowered according to the urging of the second spring 33, the upper portion of the safety arm 26 will be in a position to engage the trigger lever 11. Therefore, in this position, the upper portion of the safety arm 26 prevents the trigger lever 11 from being pulled sufficiently to bring the nail gun into the firing mode. The safety arm has a sufficient vertical length so as to provide a sufficient space between the upper surface of the pipe-shaped portion 25*a* and the lower surface of the bit guide 21 when the second spring 33 biases the safety arm 26 downwardly. A distance is provided between the upper surface of the pipe-shaped portion 25*a* and the lower surface of the bit guide 21. The distance is greater than the engagement length between the trigger lever 11 and the one end of the safety arm 26 prior to the depression of the nail 30 to the workpiece 29.

Figure 3:
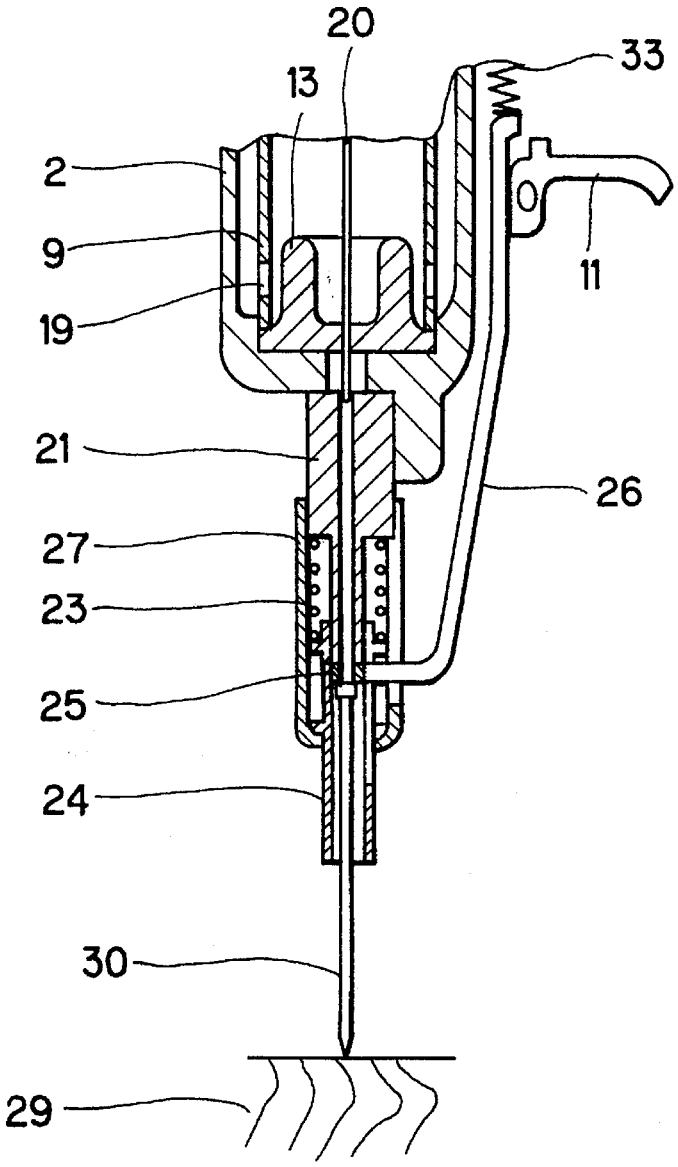
FIG. 3 is a partially longitudinal cross-sectional view showing the nail gun of FIG. 2 with a nail being inserted in a nail guide of the nail gun and pressed against a workpiece.
Figure 4:
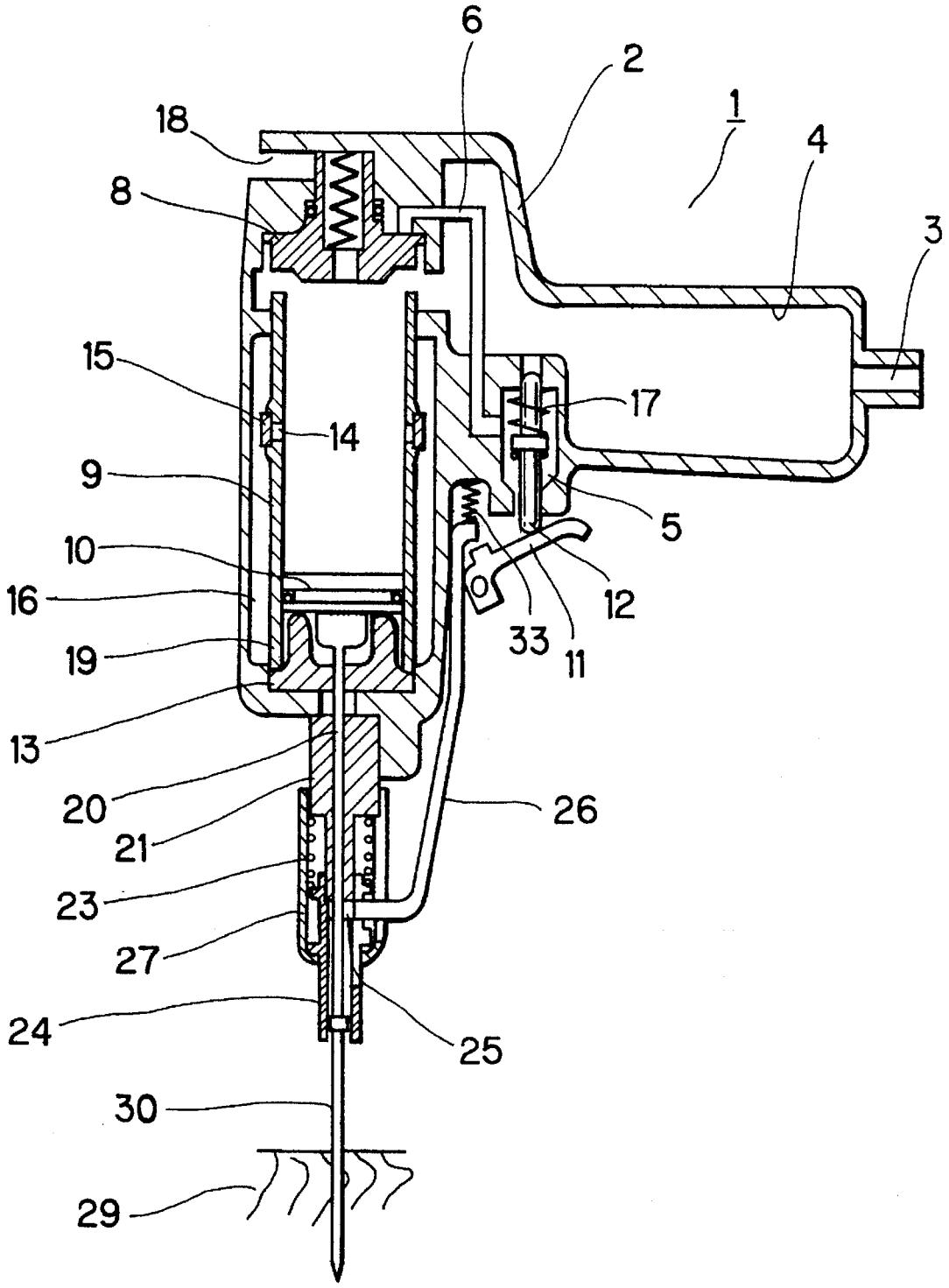
FIG. 4 is a longitudinal cross-sectional view showing the nail gun shown in FIG. 2 after striking the nail one time.

FIG. 3 shows the nail gun directly before a driving operation. A nail 30 has been inserted into the nail guide 24 and is supported therein. When an operator presses the nail gun downward so that the nail 30 presses against a workpiece 29, the movable segment 25 is pressed up by the head of the nail 30. Therefore, the safety arm 26 rises with the movable segment 25 against the urging of the second spring 33. The upper tip of the safety arm 26 lifts above the trigger lever 11 so that the trigger lever 11 is disengaged from the safety arm 26, thus, the trigger lever 11 can be operated. Pulling the trigger lever 11 brings the nail gun into the firing mode shown in FIG. 4.

When the nail gun 1 is separated from the workpiece 29, the safety arm 26 is pushed downward by the second spring 33. When the safety arm 26 lowers, its upper tip will again be in a position to prevent the trigger from being pulled.

The following is a concrete example describing dimensions of a nail gun according to the present invention. In the concrete example, the striking energy to the nail 30 is the striking energy that can drive an approximately 65 mm long box nail (i.e., nail #BN65 under JIS A5555) into a pine workpiece in about four strikes. The inner diameter of the cylinder 9 is 29 mm, the displacement of the piston 10 is 42.3 $cm^3$, and, because it is preferable that the stroke of the piston 10 be about the same length as the total length of the nail (i.e., 65 mm), the stroke of the piston 10 is 64 mm.

A nail gun structured as described above in the first preferred embodiment is provided with striking energy sufficient to drive a nail in a workpiece in several, preferably two to five, strikes. Therefore, the nail gun according to the first preferred embodiment is compact and lightweight compared to conventional nail guns which drive a nail into a workpiece in a single strike.

Figure 5:
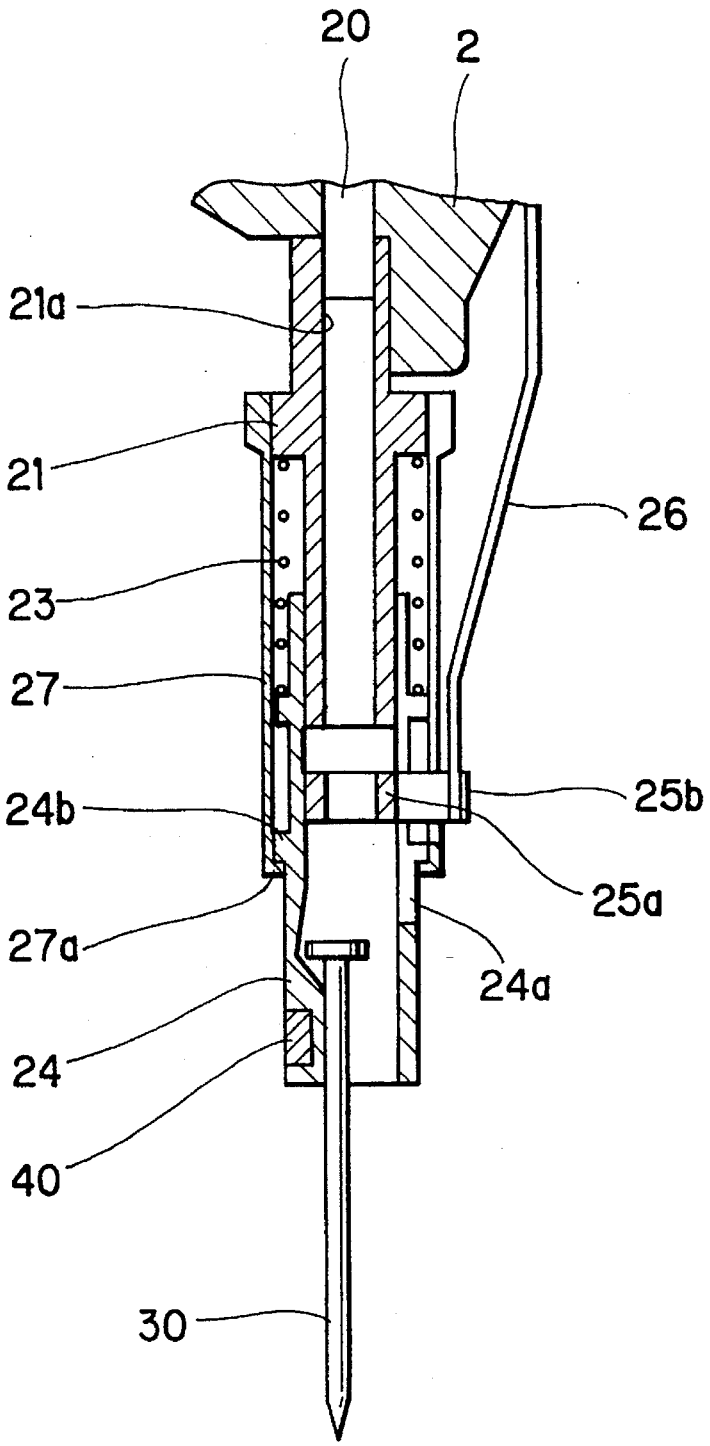
FIG. 5 is a partially longitudinal cross-sectional view showing a nail gun according to a second preferred embodiment of the present invention.

FIG. 5 shows a nail gun according to a second preferred embodiment of the present invention. In the second preferred embodiment a permanent magnet 40 is embedded in the nail guide 24. A nail 30 inserted in the nail guide 24 is held in place by magnetic attraction of the permanent magnet 40. With this structure, where to position the tip of the nail 30 can be easily determined. Also, although both hands are required to insert a nail 30 into the nail guide 24, after inserting the nail 30, an operator need only hold the nail gun with one hand, because regardless what angle the nail gun is held at, that is, upright, facing down or to the side, the nail 30 will not fall out of the nail guide 24. This increases efficiency of operation.

In both the first and second preferred embodiments, the pipe-shaped portion 25*a* of the movable segment 25 was described as being supported within the inner wall of the nail guide 24 so as to be movable in the vertical direction. However, this structure causes the following problems.

Because the nail guide 24 is guided by the bit guide 21 and the movable segment 25 is guided by the nail guide 24, the accumulated error of the dimensions of the bit guide 21, the nail guide 24 and the movable segment 25 can bring the body of the movable segment 25 into the track of the bit 20. Thus the problem arises that the bit 20 might strike and damage the movable segment 25 due to an accidentally offsetting relation between the bit 20 and the hole of the pipe-shaped portion 25*a*. Although increasing the outer diameter of the nail guide 24 and the inner and exterior diameters of the pipe-shaped portion 25*a* can solve this problem, this creates a new problem in that the larger diameter nail guide 24 would only loosely hold the nail 30. Consequently, the nail 30 would slant greatly in the nail guide 24 so that a driving operation becomes difficult. Also, the chance of the nail 30 bending when driven increases. Further, increasing the inner diameter of the pipe-shaped portion 25*a* limits the types of nails 30 which can be used in the nail gun. That is, nails 30 with head diameter smaller than the inner diameter of the pipe-shaped portion 25*a* will enter the latter. If the nail 30 enters the pipe-shaped portion 25*a*, the movable segment 25 and the safety arm 26 cannot be pushed up and the trigger lever 11 cannot be operated. Also, if the external periphery of the pipe-shaped portion 25*a* is too tightly fitted against the inner circumference of the nail guide 24, friction between the fitted surface might cause the movable segment 25 to rise when the nail guide 24 is accidentally pushed upward, for example, when transporting the nail gun. In this case, the nail gun might be accidentally fired.

Figure 6:
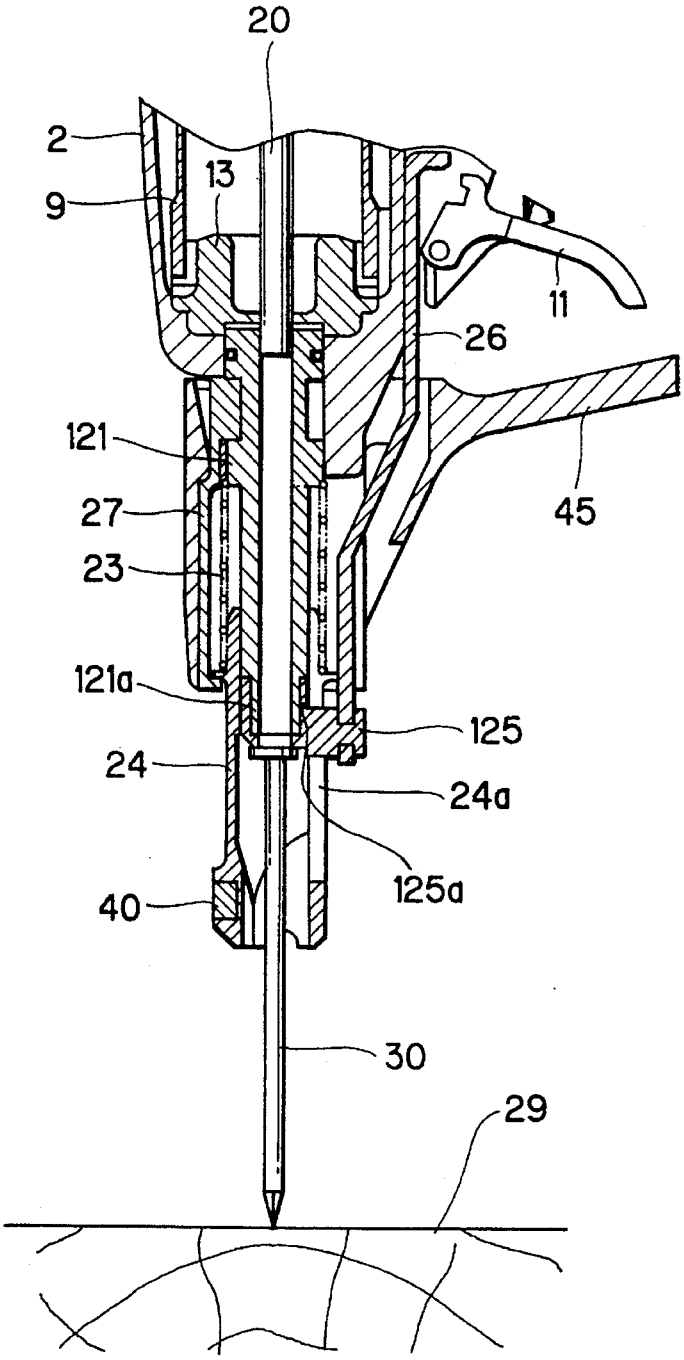
FIG. 6 is a partially longitudinal cross-sectional view showing a nail gun according to a third preferred embodiment of the present invention with a nail inserted in a nail guide of the nail gun pressed against a workpiece.

FIG. 6 shows a nail gun according to a third preferred embodiment designed to overcome the above-described problems. The movable segment 125 is supported movably in the vertical direction around the external periphery of a lower small diameter portion 121*a* of the bit guide 121. The pipe-shaped portion 125*a* of the movable segment 125 is formed with an inner wall diameter larger than the external diameter of the lower small diameter portion 121*a* of the bit guide 121, but smaller than the diameter of the head of the nail 30. The small diameter portion 121*a* has an axial length greater than the engagement length between the trigger lever 11 and the one end of the safety arm 26. Further, similar to the second embodiment, the nail guide 24 is embedded with a magnet 40 for attracting the nail 30 inserted into the nail guide.

With this structure, the movement of the movable segment 125 in the vertical direction is guided directly by the bit guide 121 rather than via the nail guide 24. As a result the movable segment 125 can be more accurately positioned so as not to be struck by the bit 20. Also, the movable segment 125 is less likely to be moved with the nail guide 24 by friction therebetween.

The foregoing embodiments described the trigger lever 11 as inoperable when the safety arm 26 is engaged with the trigger lever 11. However, this could be made into a safety device wherein a trigger arm is additionally provided between the trigger lever 11 and the trigger plunger 12 as described in a Japanese Utility Model Publication No. Sho 53-9007. Only when the trigger arm is pressed up by the safety arm 26 and the trigger lever 11, that is, only when the safety arm 26 is raised, can the trigger lever 11 be effectively operated. Only then can the trigger valve plunger 12 be raised to start drive of the piston 10.

As described above, in a nail gun according to the present invention for driving a nail long enough to protrude from the lower tip of the nail guide, unless the nail inserted in and protruding from the nail guide is pressed against a workpiece, the trigger lever cannot be operated or the trigger lever becomes ineffectual. Therefore, the piston will not be accidentally operated, thereby improving the safety of the nail gun and increasing the life of the nail gun.

While the invention has been described in detail with reference to specific embodiments thereof, it would be apparent to those skilled in the art that various changes and modifications may be made therein without departing from the spirit of the invention.

What is claimed is:

1. A pneumatically operated nail gun for striking a head of a nail into a workpiece, including:

a housing frame (2) for providing a compressed air chamber (4) connected to a compressed air source (C), a cylinder (9) disposed in the frame, a piston (10) slidably movable in the cylinder and driven by the compressed air, a bit (20) connected integrally to the piston for striking the head of the nail (30), a trigger lever (11) for selectively applying the compressed air in the compressed air chamber to the piston to move the bit, a bit guide fixed to a lower end of the housing frame for guiding reciprocal travel of the bit, a nail guide (24) slidably supported on the bit guide, the nail guide having an inner diameter greater than an outer diameter of a head of the nail, the nail having a sufficient length which is protruding from the nail guide when inserted and set therein, the improvement comprising:

said nail guide (24) being formed with an axially oriented slit (24*a*) at one side thereof;

a movable segment (25, 125) having a pipe-shaped portion (25*a*, 125*a*) and an arm portion (25*b*, 125*b*) connected to the pipe-shaped portion, the pipe-shaped portion being movably disposed within the nail guide (24) and having an inner diameter greater than an outer diameter of the bit, the arm portion being movable within the slit, the bit being operative to protrude through the pipe-shaped portion for striking the head of the nail;

a safety arm (26) having one end positioned adjacent the trigger lever (11) and another end coupled to the arm portion (25*b*, 125*b*), said one end of the safety arm being selectively engageable with the trigger lever to render the latter inoperative, and a biasing spring (33) connected to the safety arm (26) for urging the safety arm in one direction to maintain engagement between the one end of the safety arm and the trigger lever.

2. The pneumatically operated nail gun as claimed in claim 1, wherein the pipe-shaped portion (25*a*) is slidably disposed with respect to an inner peripheral surface of the nail guide (24), the pipe-shaped portion (25*a*) having a lower surface contactable with and pressed by the head of the nail (30) when the nail partly projecting from the nail guide is depressed onto the workpiece (29).

3. The pneumatically operated nail gun as claimed in claim 2, wherein a distance is provided between the upper surface of the pipe-shaped portion (25*a*) and the lower surface of the bit guide (21), and an engagement length is defined between the trigger lever (11) and the one end of the safety arm (26), and the distance being greater than the engagement length between the trigger lever (11) and the one end of the safety arm (26) prior to the depression of the nail (30) to the workpiece (29).

4. The pneumatically operated nail gun as claimed in claim 3, further comprising an additional biasing spring (23) interposed between the bit guide (21) and the nail guide (24) for urging the nail guide toward its lowermost position.

5. The pneumatically operated nail gun as claimed in claim 3, wherein the nail guide (24) is embedded with a magnet (40) for attracting the nail (30) inserted into the nail guide.

6. The pneumatically operated nail gun as claimed in claim 1, wherein the bit guide (121) has a small diameter portion (121*a*) at its lower end portion, the pipe-shaped portion (125*a*) having an inner diameter greater than a diameter of the small diameter portion (121*a*) and being slidably disposed over the small diameter portion, the pipe-shaped portion (125*a*) having a lower surface contactable with and pressed by the head of the nail (30) when the nail partly projecting from the nail guide is depressed onto the workpiece (29).

7. The pneumatically operated nail gun as claimed in claim 6, wherein an engagement length is defined between the trigger lever (11) and the one end of the safety arm (26), and the small diameter portion (121*a*) has an axial length greater than the engagement length between the trigger lever (11) and the one end of the safety arm (26).

8. The pneumatically operated nail gun as claimed in claim 7, further comprising an additional biasing spring (23) interposed between the bit guide (121) and the nail guide (24) for urging the nail guide toward its lowermost position.

9. The pneumatically operated nail gun as claimed in claim 8, wherein the nail guide (24) is embedded with a magnet (40) for attracting the nail (30) inserted into the nail guide.

* * * * *